US005258693A

United States Patent [19]

Roussel et al.

[11] Patent Number: 5,258,693

[45] Date of Patent: Nov. 2, 1993

[54] GEOMETRY CORRECTOR FOR A CATHODE RAY TUBE

[75] Inventors: Bruno Roussel, Genlis; Laurent Jourdheuil, Dijon, both of France

[73] Assignee: Videocolor, S.A., Paris, France

[21] Appl. No.: 961,197

[22] Filed: Oct. 14, 1992

[30] Foreign Application Priority Data

Oct. 9, 1990 [FR] France ..... 9,012432

Related U.S. Application Data

[63] Continuation-in-part of Ser. No. 772,803, Oct. 8, 1991, abandoned.

[51] Int. Cl.[5] ..... H01J 29/56

[52] U.S. Cl. ..... 315/370

[58] Field of Search ..... 315/370, 371, 368.25, 315/368.26, 368.27, 368.28

[56] References Cited

U.S. PATENT DOCUMENTS 4,027,219 5/1977 Van Alphen et al. ..... 315/368.27

FOREIGN PATENT DOCUMENTS 2736162 3/1978 Fed. Rep. of Germany .

1567669 5/1980 United Kingdom .

*Primary Examiner*—Theodore M. Blum

*Attorney, Agent, or Firm*—Joseph S. Tripoli; Joseph J. Laks; Francis A. Davenport

[57] ABSTRACT

A main deflection device of a cathode ray tube generates a main deflection field to deflect an electron beam on the screen of the tube. An auxiliary deflection device located between the main deflection device and the envelope of the tube generates a corrective deflection field to correct geometry errors, for example. The auxiliary deflection device includes a ring core that has a plurality of inwardly pointing projections along the ring and a plurality of associated coils that generate the corrective field. A plurality of adjustable impedances parallels the coils.

12 Claims, 6 Drawing Sheets

FIG. 5A
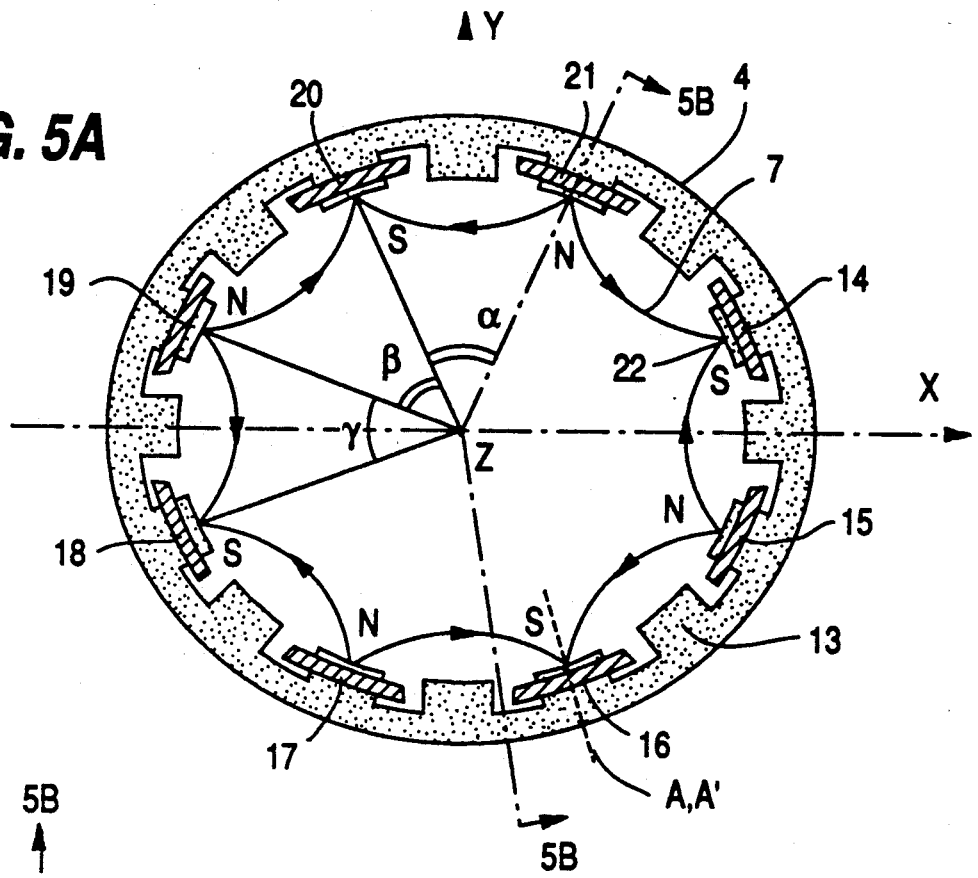
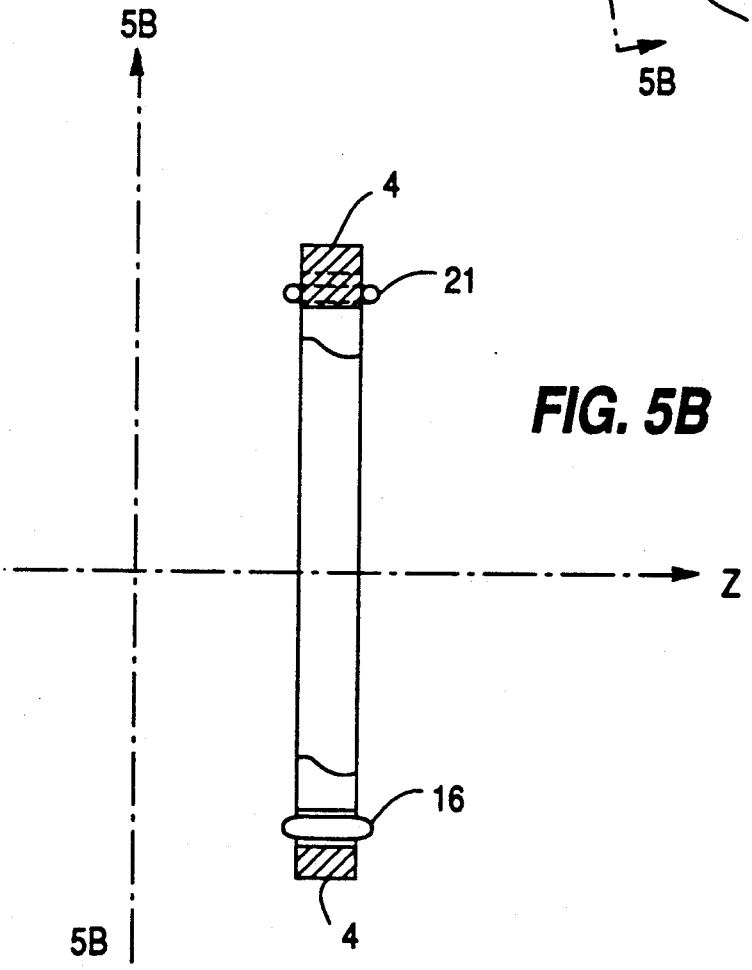
FIG. 5B

GEOMETRY CORRECTOR FOR A CATHODE RAY TUBE

This is a continuation-in-part of application Ser. No. 772,803, filed Oct. 8, 1991, now abandoned.

This invention relates to deflection apparatus for a cathode ray tube. The invention may be applied to direct view tubes and also to single beam tubes designed for e.g. projection.

In the professional electronics field, aviation or computer displays for example, the required resolution characteristics make it necessary to have the most uniform magnetic field deflector possible so that the field does not cause distortion of the electron beam which it must deflect. Moreover, for these applications, it is often necessary that the front surface of the tube, where the monochrome image is formed, be as flat as possible.

In these conditions, the image formed on the screen may have particular geometric defects such as pincushion distortion. It is known in the prior art that this pincushion distortion may be corrected by creating an octopolar auxiliary field in front of the deflector, on the screen side, which corrects the electron beam position after deflection inside the deflector. This octopolar field also allows correction of the so-called trapeze defect which can be caused by the deflector.

In prior art technology, permanent magnets distributed on the front of the electromagnetic deflection system were used to create this correction field. This type of correction has the disadvantage of being temperature sensitive and does not allow easy correction adjustment in a case where the correction has to be modified.

Prior art technology also describe a device made of coils wound around a magnetic material ring or torus, which coils are supplied by an auxiliary source. However, this last device appreciably consumes energy because part of the field closes in on itself within the ring. This defect is made much worse when the device that integrates the tube and deflector is enclosed inside a shielded enclosure, because the shielding influences the correction field and diminishes its effect.

A feature of the invention is to present a geometry correction device which corrects pincushion and trapeze defects with less consumption than that of known devices while remaining insensitive to external usage conditions.

A main deflection device of a cathode ray tube generates a main deflection field to deflect an electron beam on the screen of the tube. An auxiliary deflection device located between the main deflection device and the envelope of the tube generates a corrective deflection field to correct geometry errors, for example. The auxiliary deflection device includes a ring core that has a plurality of inwardly pointing projections along the ring and a plurality of associated coils that generate the corrective field. A plurality of adjustable impedances parallels corresponding coils.

FIG. 1 is a schematic representation of a cathode ray tube equipped with an electromagnetic deflection device and a geometric correction device according to the invention.

FIGS. 2A and 2B compare the scanning of a flat front surface with a spherical front surface to display the pincushion defect.

FIG. 3 shows the trapeze defect that can be caused by the deflector.

FIG. 4 describes construction of the correction device based on the prior art.

FIG. 5A is a front view of a corrective device based on the invention.

FIG. 5B is a cross-sectional view of the corrective device along the line 5B—5B of FIG. 5A.

Figure 1:
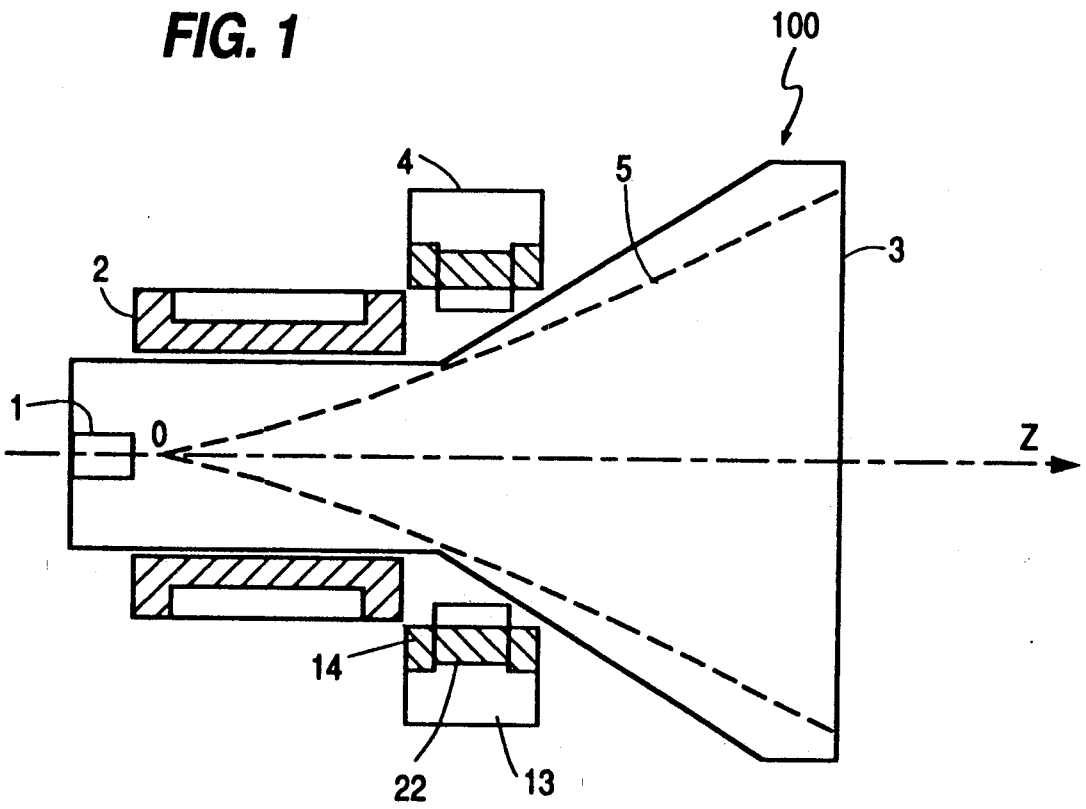

In FIG. 1, a main deflection device 2 of a cathode ray tube 100 has a central axis of revolution aligned on the tube axis Z. The deflector is installed on the tube neck and its function is to deflect the electron beam which crosses it. The beam is issued from an electron gun. In FIG. 1 we schematically show the section of the Z axis tube equipped with its deflector following the vertical plane of symmetry. The actual deflector tube is of a known type, and has a pair of coils designed to horizontally deflect an electron beam 5 issued from a gun 1 and a pair of coils designed for vertical deflection of the above-mentioned beam. Screen 3 of the cathode ray tube may be flat or convex. Its surface is oriented perpendicular to the Z axis.

In applications which require high resolution of the image created by the electron beam, it is imperative to use the most uniform deflection fields possible. In fact, were one to correct the geometry defects introduced by the specific shape of the front surface of the tube by using non-uniform vertical and horizontal deflection fields, there would result a distortion of the electron beam issued from the gun. This distortion leads to beam defocusing at certain points of the screen, which results in picture resolution degradation.

Figure 2A:
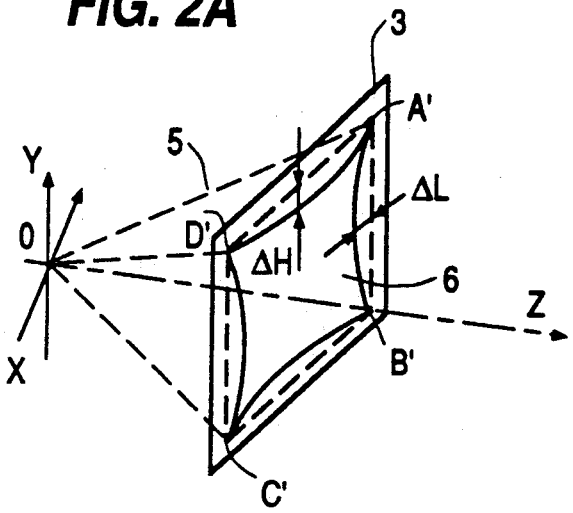
Figure 2B:
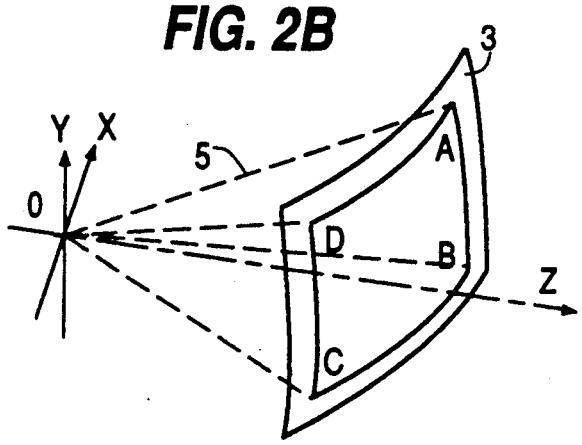

By the action of the uniform horizontal and vertical deflection fields, the volume scanned by the beam issued from the electron gun is delimited by a pyramidal surface, a surface whose apex is center O of deflector 2. FIG. 2B shows the intersection of the pyramidal surface of apex O scanned by electron beam 5 under the action of deflector 2, with a front surface 3 of the cathode ray tube showing a spherical surface whose center coincides with deflector center of deflector 2. In this case, the intersection delimits a curvilinear rectangle which demonstrates a rectangular image with a slight curvature. FIG. 2A shows the intersection of the same pyramidal surface with a front surface plane 3. This intersection determines a plane figure A'B'C'D' delimited by two crossed hyperbolas, which because of this fact, when compared with the ideal figure ABCD of FIG. 2B, causes a geometric defect called pincushion distortion, whose maximum amplitude is represented in FIG. 2A by delta H along the vertical Y axis and delta L along the horizontal X axis, H and L respectively being the height and length of the visible screen.

Figure 3:
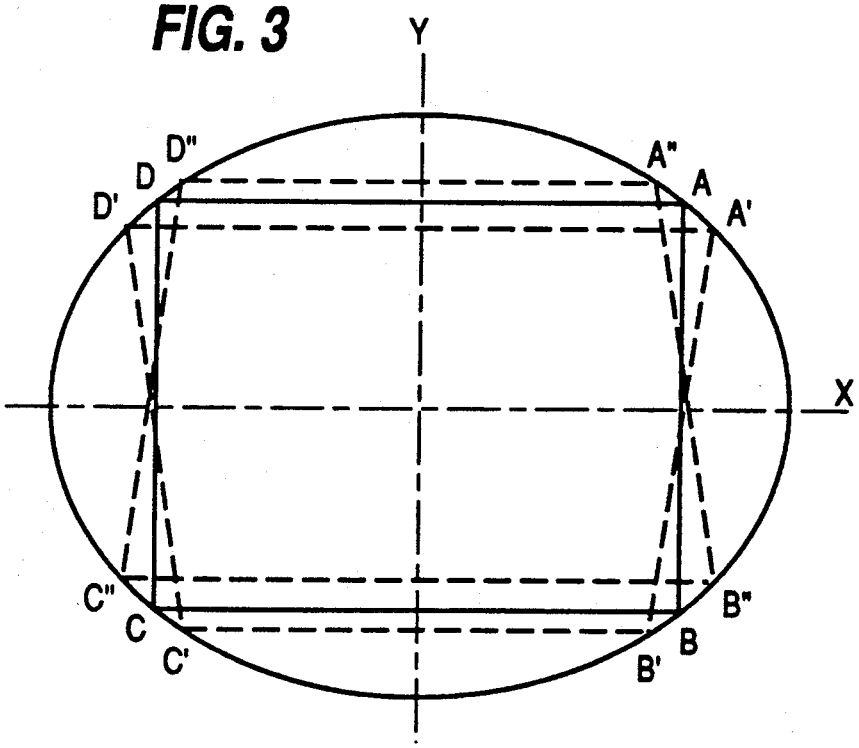

Moreover, if the pair of coils making up the vertical or horizontal deflection devices are not symmetric mechanically or magnetically in relation to the Z axis, an image defect will appear on the screen known as trapeze, which is represented in FIG. 3. The case of a vertical coil symmetry defect leads to deformation of the ABCD quadrilateral to A'B'C'D' or A''B''C''D''. When the defect is introduced by horizontal coil asymmetry, the sides AB and CD remain parallel and the trapeze defect is said to be horizontal.

Figure 4:
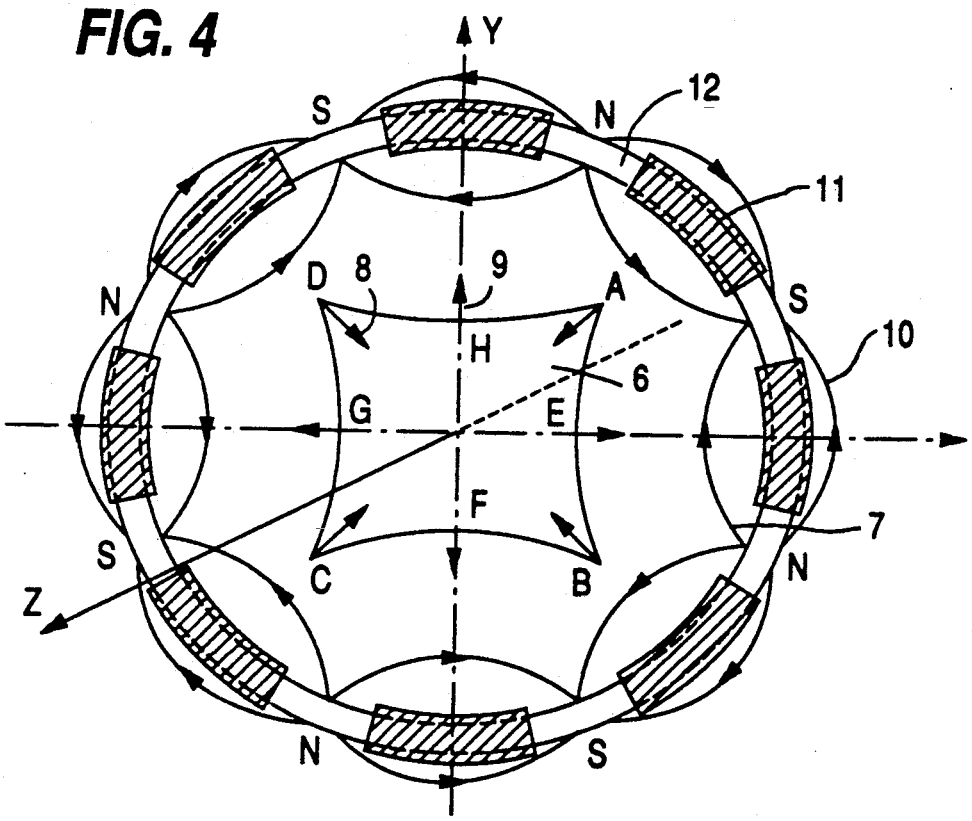

To correct the pincushion defect, a correction device 4 may be placed in front of deflector 2 as shown in FIG. 1. A prior art specific embodiment is shown in FIG. 4. The prior art device creates an octopolar magnetic field as shown in FIG. 4. The field lines 7 create electromagnetic forces 8 and 9 which act on the electron beam so the sides of image 6 created by the beam on screen 3 are perceived to be as rectilinear as possible. These forces are centrifugal type (9) in the X and Y axis direction, and centripetal type (8) in the direction of the diagonals of image 6 formed on the tube screen. The eight correction elements 11 of FIG. 4 are created either with magnets, not illustrated, or coils wrapped around a ring or torus 12. These elements are arranged in front of the deflector on the screen side. The coils 11 are supplied with DC current by an auxiliary electrical source, not shown.

As shown in FIG. 4, the field created by each coil closes in on itself from the outside, field lines 10, and inside, field lines 7, of the surface delimiting the torus. Only field lines 7 are useful for correcting geometric defects. A large part of the energy consumed by this prior art device is therefore consumed in creating an external field not used to correct the geometry defect. Moreover, if the device is inside a shielded enclosure, the shielding metal can disturb the field created by coils 11 and diminish the intensity of the usable internal field, which also results in energy waste.

A correction device which uses permanent magnets instead of coils wrapped around a torus also have disadvantages. Once permanent magnets are magnetized and installed in the geometry corrector, they do not easily allow fine adjustment adapted to the particular characteristics of each tube. The field created by a magnet may be temperature sensitive, which makes the corrector unsuitable for professional applications.

FIG. 5A shows the front view of an auxiliary deflection device 4 that provides geometry correction according to the invention. This device consists of eight coils 14 to 21, advantageously in a saddle shape, positioned inside a magnetic circuit formed by a notched ring core 13. These eight coils create eight successive north and south magnetic poles.

As illustrated in the front view FIG. 5A and the cross-sectional view FIG. 5B, the set of coils 14 to 21 is located on the inside circumference of ring core 13. Each coil has a coil axis A, generally radially disposed toward the longitudinal axis Z of the cathode ray tube. A set of notches 22 project inwardly from the inside circumference of ring core 13, with the axis A' of each notch generally coinciding with a corresponding coil axis A.

As shown in FIG. 1, auxiliary deflection device 4 is installed on the tube neck between deflector 2 and the envelope of the cathode ray tube at the rear part of the tube funnel. This correction device may be encased in a resin, ensuring both good mechanical performance and electrical insulation. The deflection device 2 may be encased in the same material and mechanically linked to device 4 to create an electromagnetic deflection assembly, making it possible to simultaneously ensure deflection and geometric correction functions.

The coils of geometry correction device 4 of FIG. 5A are arranged in four pairs of coils (14,15), (16,17), (18,19), (20,21). Each coil of a given pair is symmetrically arranged in relation to the main tube X and Y axes, the four pairs also being symmetrically arranged two by two in relation to the Z axis. The X and Y axes are symmetry axes for device 4. This means that the coil pairs (14,15) and (18,19) are symmetrically straddle the X axis. The same is true for the coil pairs (16, 17) and (20, 21) which symmetrically straddle the Y axis. Coils 14, 15, 18, 19 are electrically identical.

The coils 14 to 21 are serially connected such as to produce poles of alternating polarity and are supplied with current by an external current source 23 as indicated in FIG. 6. Each coil pair has a resistance of approximately 3.25 ohms. Variable impedances 24, 25, 26, 27 can vary between 20 to 50 ohms respectively however, a typical operating value is 30 ohms which provides an approximate correction current change of 10%.

In the example illustrated by FIG. 5A, correction device 4 is adapted to correct the pincushion defect of a square image formed on a flat screen. In this case eight coils 14 to 21 are electrically identical and placed at a 45° angle from each other. If $\alpha$ is the angular distance of two successive symmetrical poles relative to the Y axis, $\beta$ the angular distance between the two successive poles relative to the first bisector of axes X and Y, then $\gamma$ the angular distance between two symmetrical successive poles relative to the X axis, is: $\alpha=\beta=\gamma=45°$. An octopolar corrective deflection field is generated.

The corrective device 4 based on the invention may also be used to correct pincushion defects on front surfaces with an aspheric shape. The front surface of a cathode ray tube is said to be aspheric when the curvature radii along the X axis are different from the curvature radii along the Y axis. In this particular case, the action of the eight correction poles may be differentiated. For this purpose, two adjustment parameters may be used together or separately:

(1) The angular position of coils in relation to each other, i.e. $\alpha$, $\beta$, $\gamma$, with the coils still remaining electrically identical.

(2) The intensity of the fields created by coils (14,15,18,19) differs from that of fields created by coils (16,17,20,21).

Figure 6A:
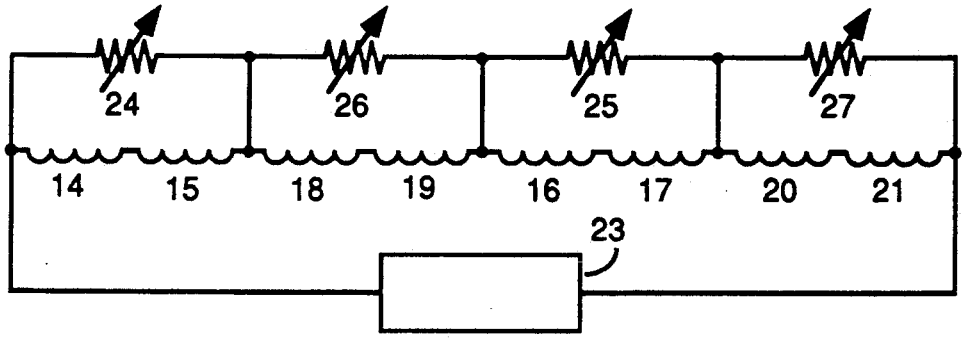
FIG. 6A is an electrical diagram for utilization of the FIG. 5 device which allows simultaneous correction and adjustment of pincushion and trapeze defects.
Figure 6B:
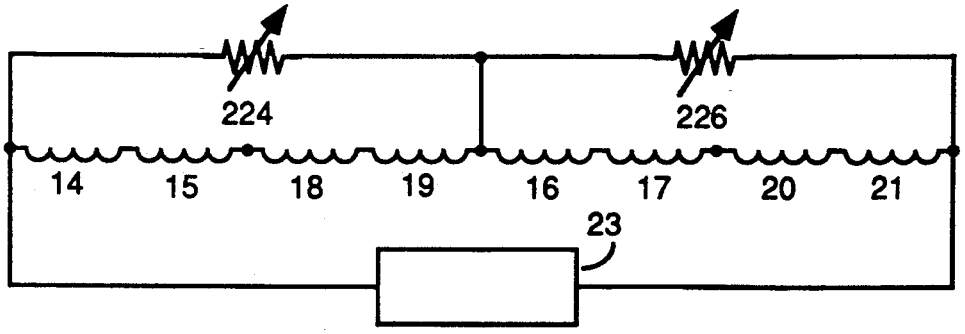
FIG. 6B is an electrical diagram for utilization of the FIG. 5A device which allows correction and adjustment of pincushion distortion resulting from an aspheric display tube surface.

FIG. 6B shows the inventive arrangement for the correction of pincushion distortion resulting from an aspherically shaped display tube face. Coils 14, 15, symmetrically straddle the X deflection axis with coils 18, 19 positioned diametrically opposite also symmetrically straddling the X deflection axis. Coils 16, 17, symmetrically straddle the Y deflection axis with coils 20, 21 positioned diametrically opposite also symmetrically straddling the Y deflection axis. Coils 14, 15, 18, 19 and coils 16, 17, 20, 21 are series connected to produce magnetic poles of alternate polarity and are coupled to a current source 23. Coils 14, 15, 18, 19 produce a different magnetic field strength to that produced by coils 16, 17, 20, 21. Adjustable impedance 224 provides an adjustment to the current in coils 14, 15, 18, 19, to provide control of left and right side pincushion respectively. Since adjustable impedance 224 varies the current through the series connected diametrically symmetrical coil pairs, no difference in magnetic field strength between the two coil pairs will be produced and thus the corrective adjustment will be symmetrical with no appreciable trapezoidal distortion of the corrective field. Adjustable impedance 226 provides adjustment of the current in coils 16, 17, 20, 21 which provides control of bottom and top pincushion respectively. For the same reasons as stated for adjustable impedance 224, adjustable impedance 226 also produces similar corrective adjustment.

The correction coils of FIG. 5A are housed on the inner surface side of the magnetic circuit. Most of the field created by these coils is nevertheless usefull for acting on the electron beam to correct its position, because the field lines 7 close in on themselves inside the magnetic circuit. In the example described in FIG. 5A, the sensitivity of the correction device is increased by use of a notched magnetic circuit. The inwardly pointing teeth or projections 22 of the circuit make it possible to bring the flux as close as possible to the location where it must act.

The use of a notched magnetic circuit allows an increase in corrector sensitivity and precise positioning of coils 14 to 21 in relation to each other. Assembly of the corrector is therefore greatly simplified.

The core which forms the magnetic circuit is advantageously created by stacking magnetic sheets, made from, for example, mu metal. Alternatively, the magnetic circuit coil is a ferrite ring having internal notches made during ring moulding.

A comparison may be made of the performances of a corrector using the invention with that of a corrector using prior art techniques for correction of an identical pincushion error, with identical space requirements, and identical power supply current.

For a square screen with a 7 centimeter diagonal, a coil power supply current of 125 milliampere, the electrical characteristics of a corrector based on prior art techniques are the following: L=10.5 millihenry, R=34.5 ohm, consumed power=0.54 watt.

The electrical characteristics of a corrector based on the invention are the following: L=2.1 millihenry, R=13 ohm, consumed power=0.2 watt.

The correction device based on the invention provides a 2.7 fold reduction in power consumption compared to the device based on the prior art technique.

The influence of the corrector may be modulated along the Z axis by modifying the height of each projection 22 along this axis.

Figure 7A:
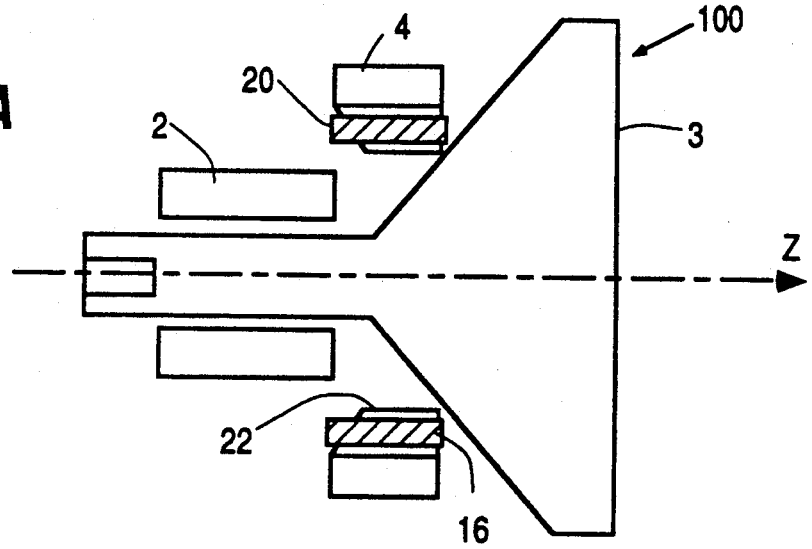
FIGS. 7A and 7B are variations in the construction of the core projections of the invention.

In the inventive embodiment shown in FIG. 7A, the height of each projection is progressively shortened in the longitudinal direction on the side of the deflection device 2 and corrector 4. This tooth shaping results in a less coupling between of deflection device 2 and corrector 4. In another embodiment shown in FIG. 7B, the height of each projection is progressively shortened on the side of correction device 4 adjacent the funnel of the tube. This allows device 4 to come into closer contact with the flaring part of the tube surface, which leads to increased corrector sensitivity.

Figure 7B:
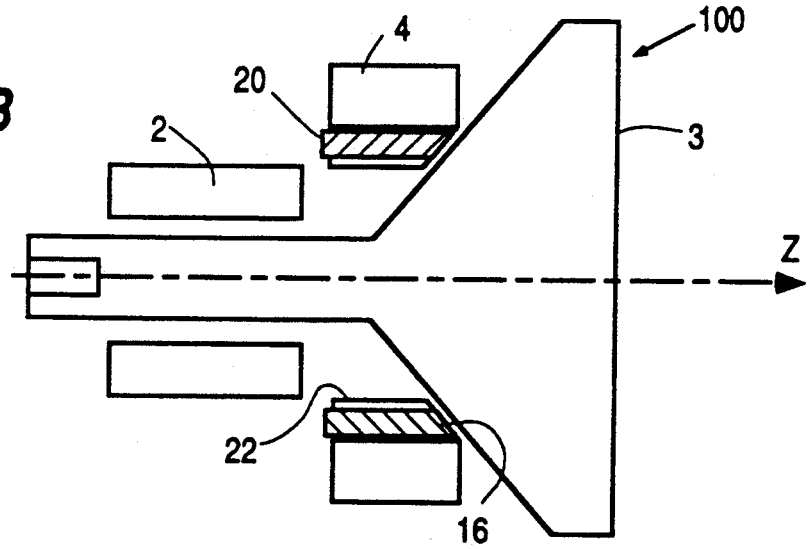

The concepts shown in FIGS. 7A and 7B may be combined to optimize the sensitivity of correction device 4.

Device 4 based on the invention makes it possible to correct the trapeze and other errors introduced by deflection device 2. The circuit of FIG. 6A provides this capability. Adjustable impedances, shown as resistors 24–27, are connected to the respective terminals of each pair of adjacent coils 14–21 that are symmetrically arranged in relation to the main tube X or Y axis. These resistors make it possible to adjust the current circulating in each pair (14,15), (16,17), (18,19), (20,21), by approximately 10% and consequently, to have a preferential correction field amplitude in an X or Y direction. In addition to varying the field in the specific coil pair under adjustment, the change in the coil pair field results in a change in the field coupled to each adjacent coil pair, i.e. flux lines shown as 7 in FIG. 5A. Thus, by adjusting resistors 24 and 26, adjustment is provided for horizontal trapeze, and by adjusting resistors 25 and 27 adjustment is provided for vertical trapeze. By using a device 4 such as shown in FIGS. 5A, 7A and 7B, the circuit of FIG. 6A is desirably endowed with good adjustment sensitivity.

What is claimed is:

1. Deflection apparatus comprising:

a cathode ray tube;

a main deflection device for generating a main deflection field to deflect an electron beam in said cathode ray tube on a screen thereof;

an auxiliary deflection device located adjacent said main deflection device for generating a corrective deflection field to provide corrective movement to said electron beam, said auxiliary deflection device including a ring core having a plurality of inwardly pointing projections along said ring and a corresponding plurality of correction coils positioned thereon, said projections and corresponding coils being angularly positioned to symmetrically straddle respective axes of deflection, said plurality of coils being series coupled with one another and with a source of current, the series current flowing in all of said coils generating a pincushion corrective field; and a plurality of adjustable impendances, each paralleling a given pair of said plurality of correction coils which symmetrically straddles an axis of deflection to controllably adjust a corrective component of current in said given pair, to thereby controllably adjust the amount of trapezoidal corrective movement provided by said corrective deflection field on said deflection axis.

2. Apparatus according to claim 1 wherein the height of each projection varies along the longitudinal axis of said tube.

3. Apparatus according to claim 1 wherein each of said coils is of a saddle shape configuration.

4. Apparatus according to claim 1 wherein said corrective deflection field is an octopolar field.

5. Apparatus according to claim 4 wherein said octopolar field provides corrective movement to said electron beam for correcting pincushion distortion on a flat screen.

6. Apparatus according to claim 5, wherein said main deflection field is a uniform field.

7. Apparatus according to claim 1 wherein the plurality of coils are arranged as pairs of adjacent coils, with each coil in a given pair being symmetrically arranged in relation to one of the main X and Y axes of the tube, and with each pair being symmetrically arranged in relation to the longitudinal axis of the tube.

8. Apparatus according to claim 7 wherein all the coils in a given pair are electrically identical.

9. Apparatus according to claim 7 wherein a corresponding one of said plurality of adjustable impedances parallels a single corresponding pair of coils.

10. Deflection apparatus comprising:

a cathode ray tube having a longitudinal Z axis;

a main deflection device for generating an X and Y axes deflection field to deflect an electron beam in said cathode ray tube on a screen thereof;

an auxiliary deflection device located adjacent said main deflection device for generating a corrective deflection field to provide corrective movement to said electron beam, said auxiliary deflection device including a plurality of coil pairs coupled in series with one another and with a source of current, the series current flowing in all of said coils generating a pincushion corrective field, said plurality of coil pairs angularly positioned around the Z axis such that a given coil pair symmetrically straddles one of the X and Y axes of the tube; and a set of adjustable impedances, a given impedance coupled across a given coil pair to controllably adjust a corrective component of current in said given coil pair, to thereby individually adjust the amount of trapezoidal corrective movement provided by said corrective deflection field at a top and bottom and left and right side of the cathode ray tube screen.

11. Deflection apparatus comprising:

a cathode ray tube having an aspherical shaped front surface;

a main deflection device for generating a main deflection field to deflect an electron beam in said cathode ray tube on a screen thereof;

an auxiliary deflection device located adjacent said main deflection device for generating a corrective deflection field to provide corrective movement to said electron beam, said auxiliary deflection device having a plurality of correction coils angularly positioned around a longitudinal axis of said tube to symmetrically straddle respective axes of deflection, said plurality of coils being series coupled with one another and with a source of current, the series current flowing in all of said coils generating a pincushion corrective field; and a plurality adjustable impedances, each paralleling corresponding two pairs of said plurality coils angularly positioned diametrically opposite and symmetrically straddling an axis of deflection, to controllably adjust a corrective component of current in said corresponding two pairs, to thereby controllably adjust the amount of corrective movement provided by said corrective deflection field on said deflection axis.

12. Apparatus of claim 11 wherein the two pairs of coils angularly positioned diametrically opposite and symmetrically straddling a first axis of deflection, produce a magnetic field strength different to that of the two pairs of coils angularly positioned diametrically opposite and symmetrically straddling a second axis of deflection.

* * * * *